United States Patent [19]

Hall

[11] Patent Number: 4,516,895

[45] Date of Patent: May 14, 1985

[54] BAG FORMING MACHINES OF THE TOP STACKING TYPE WITH STACK CLAMP

[75] Inventor: Arthur Hall, Rochdale, England

[73] Assignee: Alpine Plastics Machinery Limited, Runcorn, England

[21] Appl. No.: 480,864

[22] Filed: Mar. 31, 1983

[30] Foreign Application Priority Data

Apr. 5, 1982 [GB] United Kingdom ..... 8210065

[51] Int. Cl.[3] ..... B65H 31/30

[52] U.S. Cl. ..... 414/43; 271/148; 271/214; 493/204

[58] Field of Search ..... 414/43, 115; 271/148, 271/214; 493/204

[56] References Cited

U.S. PATENT DOCUMENTS

| | | | |
|---|---|---|---|
| 3,239,218 | 3/1966 | Reeves | 271/148 |
| 3,871,539 | 3/1975 | Nikkel | 414/43 X |
| 4,043,458 | 8/1977 | Schott | 414/43 X |
| 4,117,771 | 10/1978 | Brinkmeier | 414/43 X |
| 4,297,066 | 10/1981 | Ramcke et al. | 414/43 |
| 4,396,379 | 8/1983 | White et al. | 493/204 X |

FOREIGN PATENT DOCUMENTS

| | | | |
|---|---|---|---|
| 2508745 | 9/1976 | Fed. Rep. of Germany | 414/43 |
| 1327520 | 8/1973 | United Kingdom . | |
| 1350224 | 4/1974 | United Kingdom . | |
| 1505625 | 3/1978 | United Kingdom . | |

*Primary Examiner*—Leslie J. Paperner

*Attorney, Agent, or Firm*—William R. Hinds

[57] ABSTRACT

A bag forming machine of the top stacking type has means at the stacking station whereby a stack (12) of bags are clamped during high acceleration arising in their transfer from the stacking position at the station to a discharge conveyor (11). By employing high accelerations and clamping the stack can be transferred without interrupting the rhythm of delivery of bags to the stacking station. The bags are clamped at their "cut" ends by a first clamp (14, 15) during stacking and are then clamped at a second clamp (22, 24), moving transversely to the stack so as to apply dragging motions to the stack to move the "cut" ends of the bags away from the first clamp and to present the "weld" ends of the bags at a roll nip (30, 31) which feeds to the conveyor.

9 Claims, 6 Drawing Figures

BAG FORMING MACHINES OF THE TOP STACKING TYPE WITH STACK CLAMP

BACKGROUND TO THE INVENTION

This invention relates to bag forming machines of the top stacking type and is primarily concerned with such machines for forming bags from webs of thin (less than 0.025 mm) synthetic plastics material.

There is a natural inclination to design bag forming machines to operate on a continuous rhythmic basis throughout but there is inherently a limitation in that the formed bags are required to be stacked and removed in batches. In top stacking types of machines currently in use, the bag forming line is arrested whilst a stack of bags is removed and the stacking station re-set to begin re-stacking. Design solutions to the above limitation are restricted in that a stack of bags of thin synthetic plastics material are unstable. Individually bags are slippery and nearly air buoyant. They cannot be moved at high speed unsupported or accelerated or decelerated rapidly.

SUMMARY OF THE INVENTION

According to the present invention a bag forming machine of the top stacking type having a delivery line for rhythmically top stacking formed bags at a stacking station is characterised in that means are provided at the stacking station whereby a stack of bags, when formed, can be removed from the station without interrupting the rhythm of delivery by a clamp acting on the stack and movable transversely of the stack so as to apply a dragging motion to the stack.

The invention provides that the stack is continuously clamped until presented to a conveyor and the stack can therefore be moved at high accelerations such as is required to fit the removal of a stack into approximately the brief interval (e.g. 200–500 m/secs depending on bag length) between delivery of consecutive bags to the stacking station.

When operating with bags made of thin material it is recognised practice to air extend them and lay them on the stack. This can cause floatation of the free ends of the bags in the stack as it is moved from the stacking station with attendant problems. In a preferred form of the invention the end (the "cut" end) of the stack adjacent to the delivery line is lowered just prior to, or on, moving of the stack so as to shield that end from the air laying apparatus. In a further preferred form of the invention it is arranged that the first laid bag of the following stack provides a further shield as the stack is moved further along its discharge route.

BRIEF DESCRIPTION OF THE DRAWINGS

One form of the invention with modifications will now be described with reference to the accompanying drawings in which.

DESCRIPTION OF THE PREFERRED EMBODIMENTS

Figure 1:
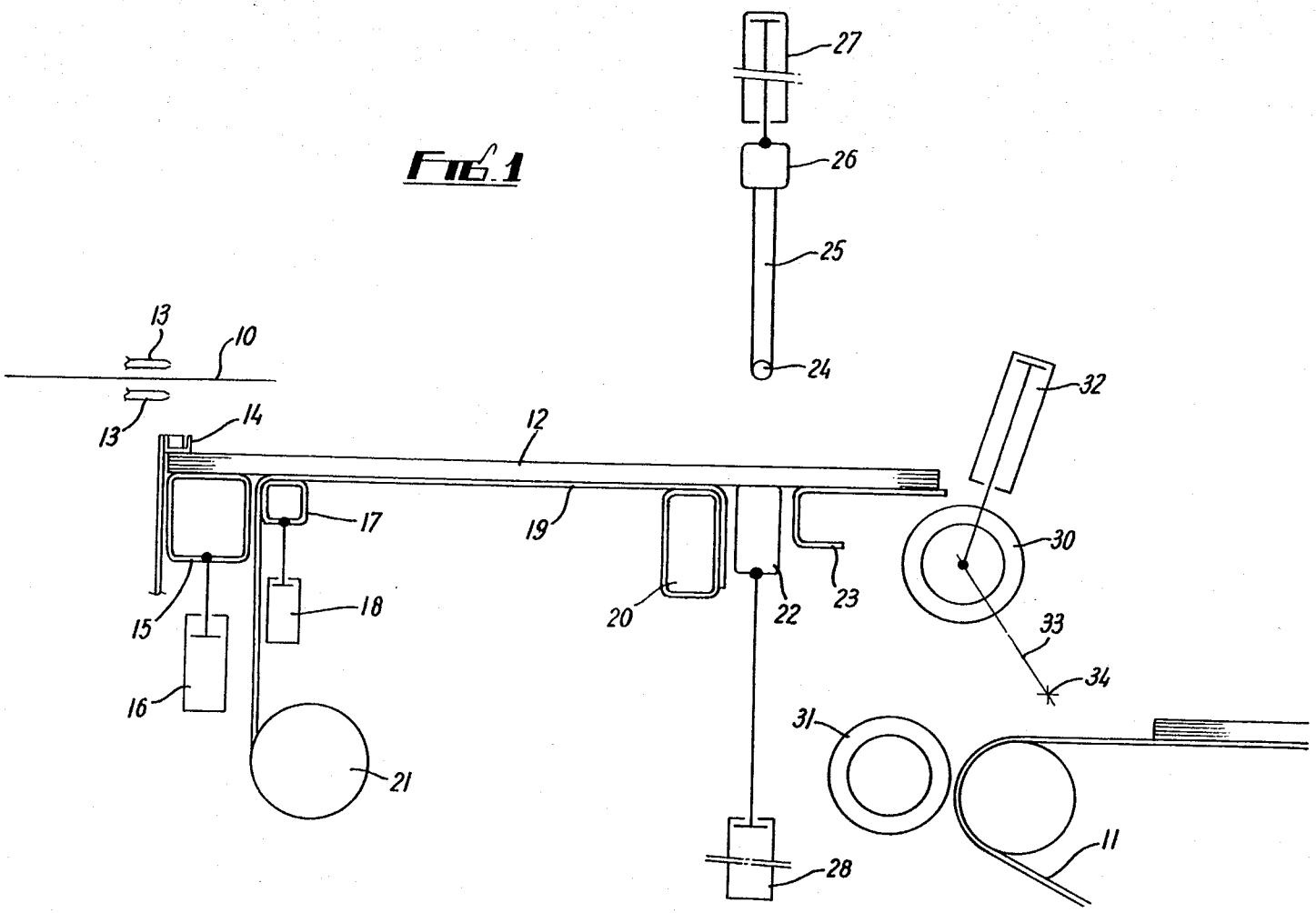
FIG. 1 is a diagrammatic side elevation presentation of a machine according to the invention at the instant of completing delivery of a last bag to a stack.

In the drawings the line 10 represents bag forming web being delivered along a delivery line to a stacking station. Line 11 represents a conveyor forming a discharge line for a stack of bags from the stacking station. A stack 12 of bags is being formed at the stacking station. Jets 13 are shown to indicate means for air extending and laying of the bags at the stacking station. At the stacking station the bags, with their welded ends leading and cut ends trailing, are held at their cut ends by a clamp comprising a fixed member 14 and a movable bar 15. The bags are top stacked (that is one on top of the other) in a flat lay. The clamp opens for each bag in the known manner. The bar is powered by a cylinder 16.

An auxiliary bar 17 is provided which can be raised and lowered by a cylinder 18. This bar supports a cloth table 19 which extends from a bar 20, over the bar 17 and onto a wind-up roller 21.

The stack 12 is laid on bar 15, bar 17, table 19, bar 20, lower bar 22 of a clamp (to be described) and a rest 23. Above the lower bar 22 there is an upper light-weight bar 24 carried on verticals 25 from a bar 26 actuated by a cylinder 27. Bars 22 and 24 form a clamp which grip the stack 12 at the "weld" end of the stack. Lower bar 22 can be held lowered by a cylinder 28. Its actual lowering is caused by action of the bar 24.

The machine also has a pair of nip rolls 30, 31; the upper one of which can be moved by a cylinder 32 on an arm 33 moving about an axis 34.

It will be appreciated that the various bars extend across the width of the machine and, when powered, will each have cylinders on both sides of the machine. Appropriate end bearings and guides are provided.

Components 14, 15, 16, 17 and 18 can be regarded as fixed in position along the line of the machine. The other components are mounted on a carriage and are movable along the machine line depending upon the length of bags to be laid. Typically this can be in the range of 200–1200 mm.

Figure 2:
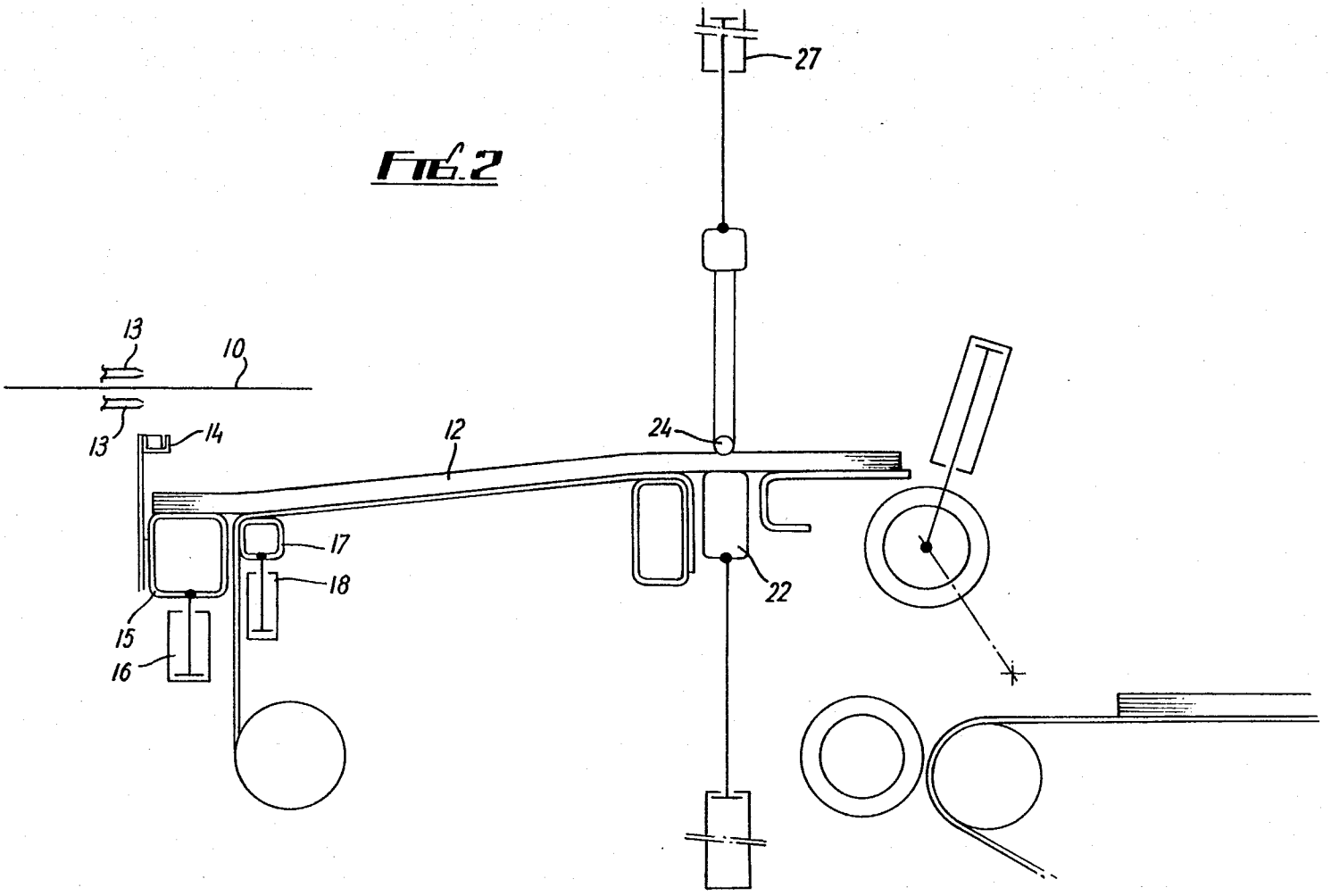
FIGS. 2, 3, 4 and 5 are similar presentations to that of FIG. 1 except that they show the operation of the machine at sequential stages in one cycle.

FIG. 2 shows the same components as FIG. 1 but with a changed state of operation. Cylinders 16, 18 and 27 have been powered to lower respectively bars 15, 17 and 24. Thus FIG. 2 shows the stack 12 released from the clamp defined by items 14, and 15 but held (near the "weld" end of the stack) by the clamp defined by items 22 and 24. Clamp 14/15 opens as clamp 24/22 closes.

Figure 3:
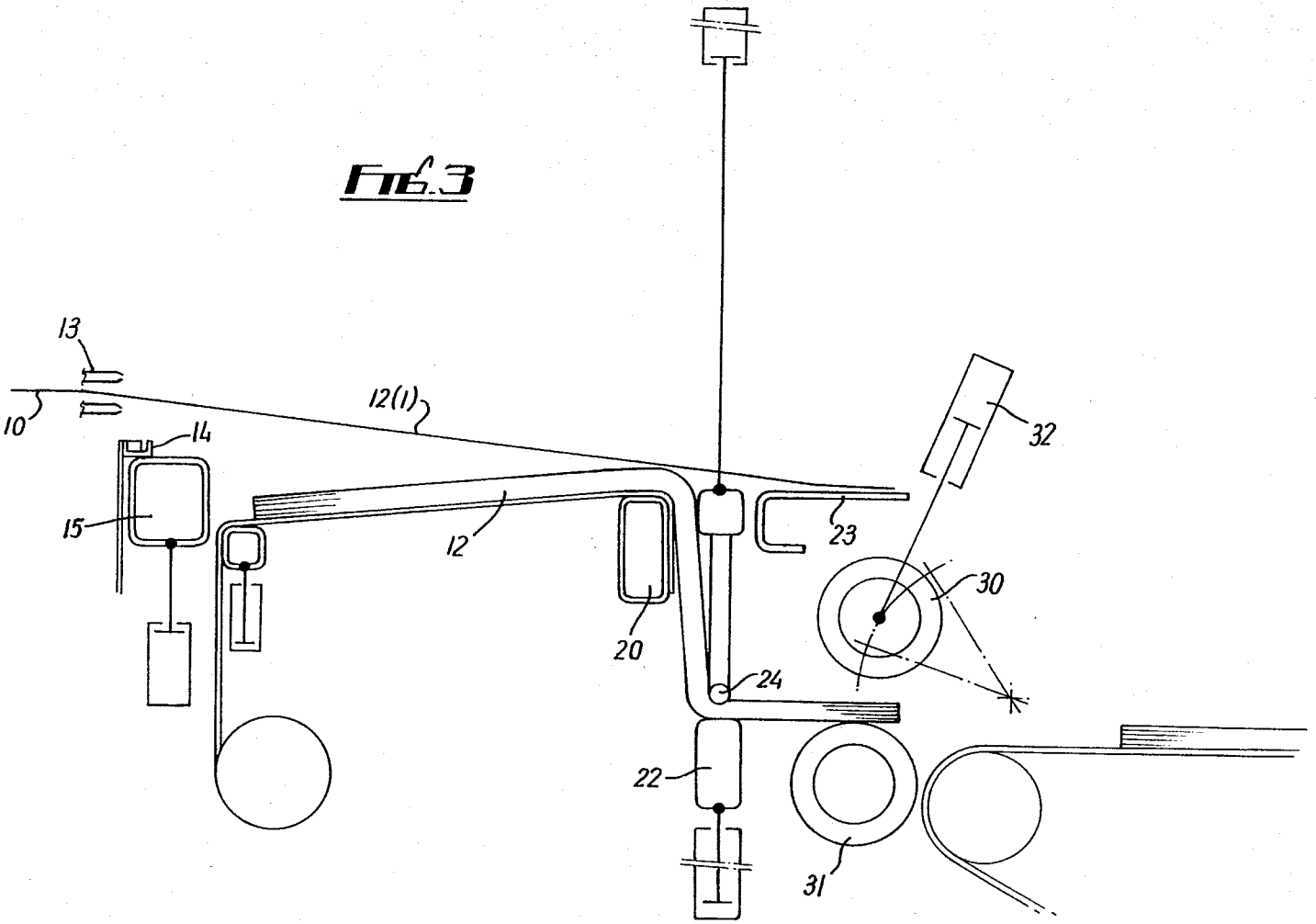

FIG. 3 shows a further state of operation. The clamp 14/15 has restored to the closed position. Clamp 22/24 has lowered and dragged the "cut" end of the stack 12 over the bar 20 and the "weld" end over the rest 23 to present the "weld" end at the nip of rolls 30, 31; roll 30 having started to move downwardly by the powering of cylinder 32. As the rhythm of bag feed has not been interrupted the first bag of a new stack 12(1) has been air laid with its "weld" end on rest 23. The "cut" ends of stack 12 are sheltered from the air from the lower nozzles 13 by bar 15.

Figure 4:
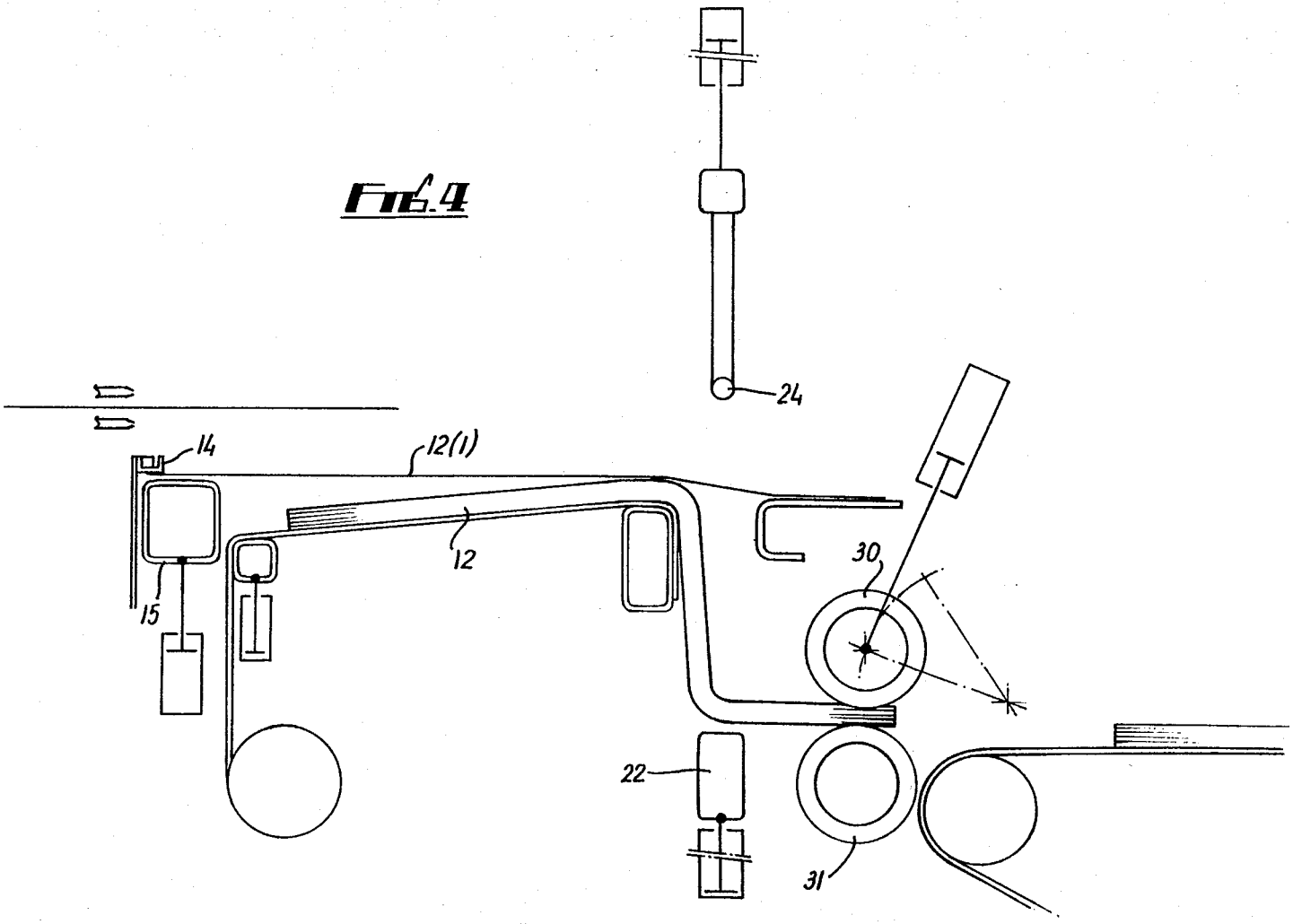

FIG. 4 shows retraction of the clamp 22/24, the closure of nip 30/31 and the laying of the lowermost bag of stack 12(1) with its "cut" end in clamp 14/15. Stack 12 is now fully sheltered from nozzles 13 by the lowermost bag of stack 12(1).

Figure 5:
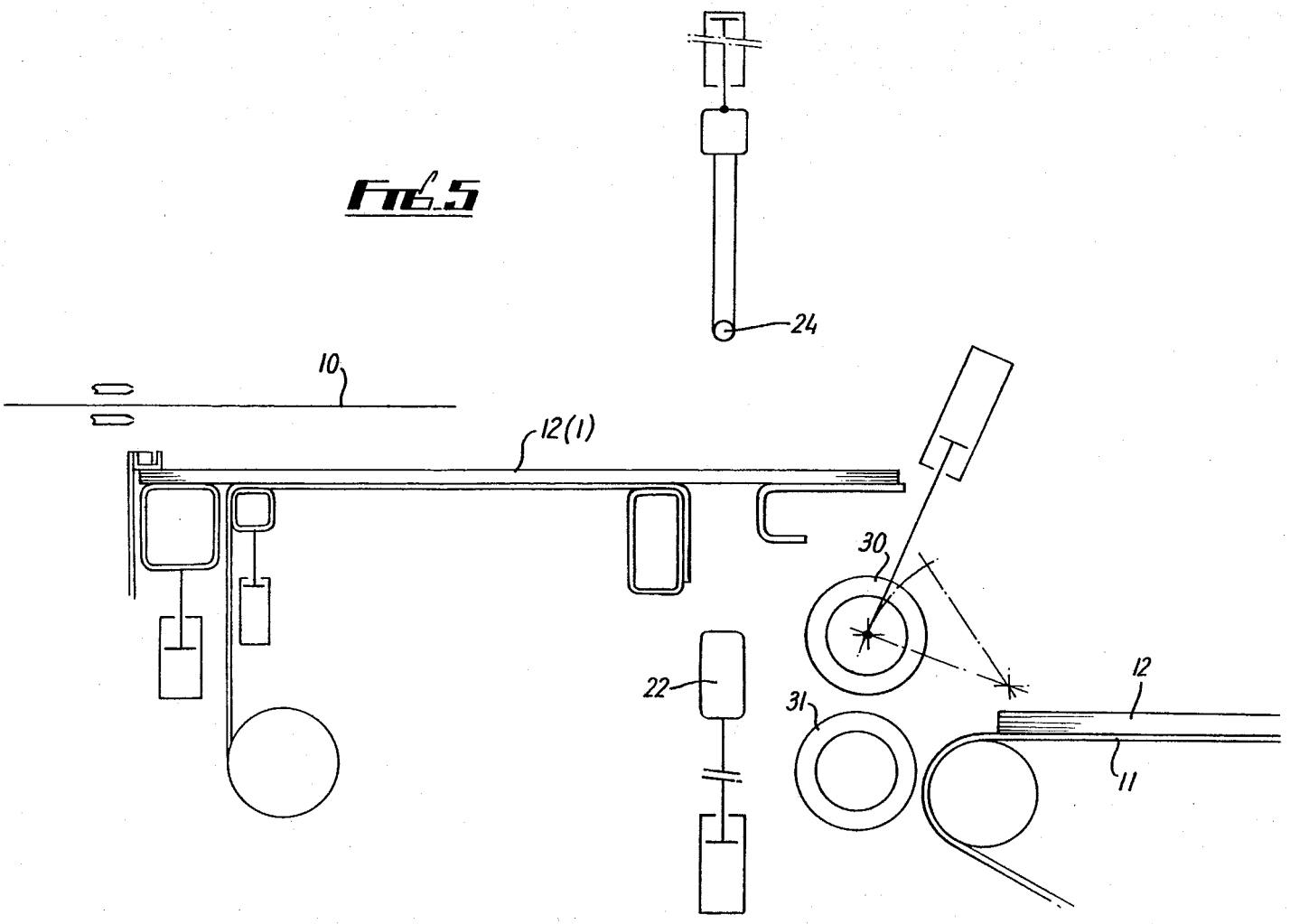

In FIG. 5 the FIG. 1 position is being re-established. The new stack 12(1) is half formed. The nip 30/31 is opening fully. The stack 12 is being removed unclamped along the conveyor 11. The bar 22 is being raised in readiness for the next action at clamp 22/24. The conveyor can move with zero or low accelerations and hence the stack 12 does not require clamping on the conveyor although this could be provided.

There is a controller (not shown) which provides a timed operating sequence. This is now described.

A small time interval before the last (uppermost) bag is laid on stack 12 the cylinder 27 is powered to down traverse bar 24 and the cylinder 18 is powered to down traverse bar 17. N milliseconds later the cylinder 16 is powered to lower bar 15 (N varies with stack height). This takes the operation to FIG. 2 and the final stage of the stroke of cylinder 27 takes the clamp 22/24 to the FIG. 3 position. Bar 22 is pushed down by bar 24. This drags the "cut" end of the stack 12 from the clamp 14/15 and the "weld" end of the stack is folded over bar 20 and dragged from rest 23 with the "weld" end of the stack then offered to the nip 30/31.

A first microswitch (not shown) 15 mm from the end of the stroke of cylinder 27 operates to cause the energisation of cylinder 32 to down traverse the nip roll 30 and de-energise cylinder 16 so that the bar 15 up traverses to its clamp position with member 14 in readiness to accept the following bags of the new stack 12(1).

15 mm from the end of the down traverse of nip roll 30 a second microswitch (not shown) is operated and 50 m. secs. thereafter a valve controlling cylinder 27 is changed to cause bar 24 to up traverse. At the same time a valve controlling cylinder 28 is operated so that bar 22 is held down.

As bar 24 rises the first microswitch is restored. This starts the nip 30/31 and conveyor 11 so that stack 12 appears on the conveyor. At the same time the first (bottom) bag of the new stack 12(1) is held at clamp 14/15. This acts to cover the "cut" end of stack 12 from air from nozzles 13. Cylinder 18 is then de-energised so that bar 17 up traverses. The valve controlling cylinder 28 is de-energised and this permits bar 22 to up traverse thus bringing the machine to the FIG. 5 position. As a last step cylinder 32 is vented to bring nip roll 30 to the FIG. 1 position and bar 22 also reaches the FIG. 1 position.

Figure 6:
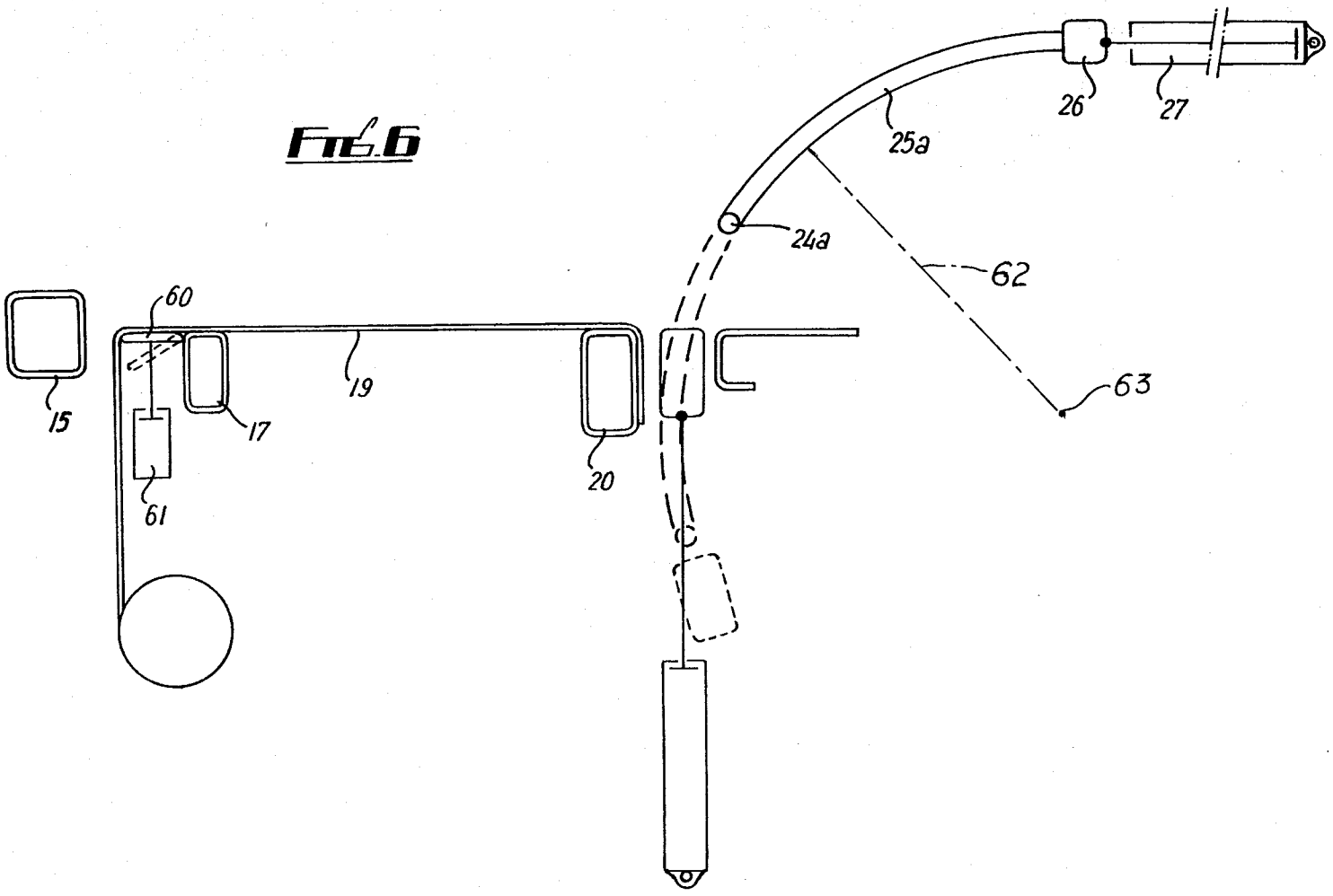
FIG. 6 shows possible modifications.

In the FIG. 6 modification a flap 60 powered by a cylinder 61 is located between the bar 15 and bar 17. The bar 17 is no longer powered to move. It is arranged for the flap 60 to traverse downward just prior to the bar 24 arriving at the position shown in FIG. 2. This causes the "cut" end of stack 12 to drop which has a similar lowering effect to that of lowering the bar 17.

In a further modification the bar 24 and verticals 25 are replaced with a bar **24*a* and arcuates 25*a*. The arcuates are carried on an arm 62 pivoted at axis 63. The operating cylinder 27 is not horizontal. This allows lower head room and also provides an arcuate surface on which the first bag of the following stack 12(1)—see FIG. 3, can be laid prior to the cylinder 27** being energised to retract.

Both modifications can be used separately or together.

I claim:

1. In a bag forming machine of the top stacking type having a delivery line for rhythmically top stacking formed bags at a stacking station, the improvement comprising a support at the stacking station for the rear end of the stack, and means at the stacking station for removing a stack of bags, when formed, from the station without interrupting the rhythm of bag delivery to the station, said means comprising a clamp acting on the stack and movable transversely of the stack so as to move the front end of the stack transversely and apply a dragging motion to the rear end of the stack to move the rear end of the stack forwardly sufficiently to move the rear end of said stack off said support to permit said support to receive and support the rear end of the first bag of the next stack to be formed.

2. A machine as claimed in claim 1 comprising supporting means on which the stack is formed, said supporting means comprising a table, a bar and a rest, means for lowering the table at the end remote from the bar prior to dragging the stack, in which said clamp acts on the stack between the bar and the rest so as to drag the rear end of the stack off said support and along the table towards the bar and to drag the front end from the rest to present that end, below the rest, to a pair of nip rolls which feed to a conveyor.

3. A machine as claimed in claim 2 having air extending and laying means in which the laying of the lowermost bag of the following stack shades the stack being removed from air coming from said means.

4. A machine as claimed in claim 3 in which the clamp comprises, as one clamping component, a member carried on arcuates on a pivoted arm.

5. A machine as claimed in claim 2 in which said table is lowerable by a flap forming a part of the table.

6. A machine as claimed in claim 2 in which the clamp comprises, as one clamping component, a member carried on arcuates on a pivoted arm.

7. A machine as claimed in claim 2 wherein said support for the rear end of the stack comprises part of a rear end clamp for receiving and holding the rear ends of the bags of a stack, and the dragging motion of the rear end of the stack caused by said transversely moving clamp is sufficient to move the rear end of the stack forwardly clear of said rear end clamp, and wherein said support includes means for lowering and raising the support with or independently of said table end, whereby said support can be lowered with said table end and raised independently of said table end.

8. A machine as claimed in claim 1 in which the clamp comprises, as one clamping component, a member carried on arcuates on a pivoted arm.

9. A machine as claimed in claim 1 wherein said support for the rear end of the stack comprises part of a rear end clamp for receiving and holding the rear ends of the bags of a stack, and the dragging motion of the rear end of the stack caused by said transversely moving clamp is sufficient to move the rear end of the stack forwardly clear of said rear end clamp.

* * * * *